US006187349B1

(12) United States Patent
Sulpizio

(10) Patent No.: US 6,187,349 B1
(45) Date of Patent: Feb. 13, 2001

(54) BEVERAGE BAG ASSEMBLY FOR PREPARING HOT OR COLD BEVERAGES

(76) Inventor: Alfred Sulpizio, 1206 Waverly Walk, Philadelphia, PA (US) 19147

( * ) Notice: Under 35 U.S.C. 154(b), the term of this patent shall be extended for 0 days.

(21) Appl. No.: 09/439,691

(22) Filed: Nov. 15, 1999

Related U.S. Application Data

(60) Provisional application No. 60/108,776, filed on Nov. 17, 1998.

(51) Int. Cl.[7] ..... B65B 29/04; B65D 33/12
(52) U.S. Cl. ..... 426/83; 426/77
(58) Field of Search ..... 426/77–84; 206/5

(56) References Cited

U.S. PATENT DOCUMENTS

| | | | | |
|---|---|---|---|---|
| 2,199,406 | * | 5/1940 | Jablon | 426/83 |
| 2,334,156 | * | 11/1943 | Hansen | 426/83 |
| 2,614,934 | * | 10/1952 | Trotman | 426/83 |
| 2,698,082 | * | 12/1954 | Maloney | 426/82 |
| 2,728,670 | * | 12/1955 | Young et al. | 426/82 |
| 2,800,408 | * | 7/1957 | Fimple | 426/80 |
| 2,839,406 | * | 6/1958 | Steinthal | 426/83 |
| 2,986,269 | * | 5/1961 | Goldberg | 426/83 |
| 3,379,331 | * | 4/1968 | Kamlet | 426/82 |
| 3,387,978 | * | 6/1968 | Major | 426/80 |
| 4,153,153 | * | 5/1979 | Herzog | 426/83 |
| 4,726,956 | * | 2/1988 | Christie | 426/77 |
| 4,875,574 | * | 10/1989 | Travers | 426/82 |

FOREIGN PATENT DOCUMENTS

| | | | | |
|---|---|---|---|---|
| 2229991 | * | 10/1990 | (GB) | 426/77 |

* cited by examiner

*Primary Examiner*—Steven Weinstein
(74) *Attorney, Agent, or Firm*—Akin, Gump, Strauss, Hauer & Feld, L.L.P.

(57) ABSTRACT

A beverage bag having a porous holder for receiving a beverage making component and a tab secured to the porous holder is disclosed. The tab comprises a first and a second layer. While the first layer is impervious to liquids, the second layer, secured to the first layer is formed of a moisture absorbent material. The first and second layers form a butler for receiving the porous holder after the beverage has been made. Initially, the tab is folded to the size and shape of a standard tab, and is thereafter unfold-able to form the butler which is sized to receive the porous holder.

2 Claims, 2 Drawing Sheets

BEVERAGE BAG ASSEMBLY FOR PREPARING HOT OR COLD BEVERAGES

CROSS-REFERENCE TO RELATED APPLICATIONS

This application claims the benefit of U.S. Provisional Application Ser. No. 60/108,776, filed Nov. 17, 1998.

BACKGROUND OF THE INVENTION

The present invention relates generally to beverage preparation bags of the type which may be used for brewing or preparing tea, coffee or other hot or cold beverages or the like, and more particularly, is directed to such a beverage preparing bag which includes an enhanced disposal feature.

Beverage bags of the type used for making tea, coffee or other such beverages are generally well known. Although tea bags are referenced throughout the remainder of the present specification, it will be appreciated that the present invention is equally applicable to coffee bags or other porous holders utilized for producing other hot or cold beverages.

A typical beverage bag such as a tea bag is comprised of a porous holder-like structure for housing the tea leaves and a fob, tag, tab or the like attached to the porous holder with a string. In preparing a cup of tea, the porous holder is dropped into a cup of hot water and the tab is draped over the edge of the cup permitting the brewing of the tea to proceed. When the tea has been brewed to the desired strength, the user typically utilizes the tab to lift the porous tea bag out of the cup and, after possibly squeezing additional tea from the tea bag, the user is faced with a problem, what to do with the used tea bag. If the user happens to have a saucer underlying the cup, the used tea bag can be placed on the saucer. With this solution, some of the liquid tea from the tea bag eventually leaks out of the tea bag and into the saucer whereupon it sticks to the undersurface of the cup resulting in a potentially messy situation when the cup is lifted for consumption of the tea. If the user is drinking the tea out of a mug, typically no such saucer is provided and the user is faced with a dilemma with respect to what to do with the tea bag. Typically, the user will either place the tea bag on a napkin or simply place the tea bag on a table or other supporting surface for later disposal. Neither one of these solutions is particularly desirable since neither is terribly attractive and both result in a mess on the table, which eventually must be cleaned up.

There is a need for convenient, elegant solution to the problem of how to depose of a used tea bag in a conventional manner which is not unsightly and will not require additional clean up. The present invention provides an elegant solution to the problem.

BRIEF SUMMARY OF THE INVENTION

Briefly stated the present invention comprises a beverage bag for preparing hot or cold beverages with an enhanced disposal functionality. The beverage bag includes a porous holder for containing a beverage making component, and a tab secured to the porous holder using a string. The porous holder is insertable into a liquid to prepare the hot or cold beverage. The tab may be unfolded to form a butler for receiving the porous holder after the beverage has been prepared.

In another aspect, the present invention comprises a tab secured to a porous holder for receiving a beverage making component. The tab comprises a first layer impervious to a liquid and a second layer secured to the first layer and formed of a moisture absorbent material. The first and second layers form a butler for receiving the porous holder after the beverage has been made.

In a further aspect, the present invention comprises a beverage bag having a porous holder for containing a beverage making component and for being inserted into a liquid for making a beverage. A tab is secured to the porous holder and the tab is unfoldable into a butler which is sized for receiving the porous holder after the beverage had been made. The butler is impervious to liquid on a first surface and absorbent to liquid on a second surface.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentality shown. In the drawings.

DETAILED DESCRIPTION OF THE INVENTION

Figure 1:
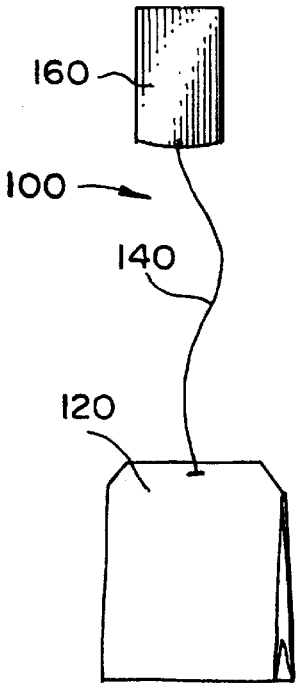
FIG. 1 is an elevational view of a preferred embodiment of a beverage bag having an enhanced disposal feature in accordance with the present invention.

In the drawings, like numerals are used to indicate like elements throughout. FIG. 1 is an elevational view of a preferred embodiment of a beverage bag 100 having an enhanced disposal feature according to the present invention. More specifically, the beverage bag 100 incorporates a tab 160 that unfolds to form a butler 300 (FIG. 3) for receiving a used porous holder 120 after the beverage is prepared.

The beverage bag 100 includes the porous holder 120 having a bag-like shape for receiving and retaining a beverage-making component (not shown) in a manner typical of conventional beverage bags, such as a tea bag, for example. The beverage bag 100 also includes a fastener 140 having a proximal and a distal end. The distal end of the fastener 140 is secured to the porous holder 120 while the proximal end is attached to the tab 160. The fastener 140 may be a string of the type and length consistent with conventional beverage bags. The tab 160, although initially sized and shaped like a conventional tab, is different from conventional tabs typically employed with existing beverage or tea bags. The present invention provides an enhanced tab 160 which is capable of being unfolded to form a butler 300 further referenced in FIG. 3, for receiving and retaining thereon the porous holder 120 after the beverage has been prepared.

Figure 2A:
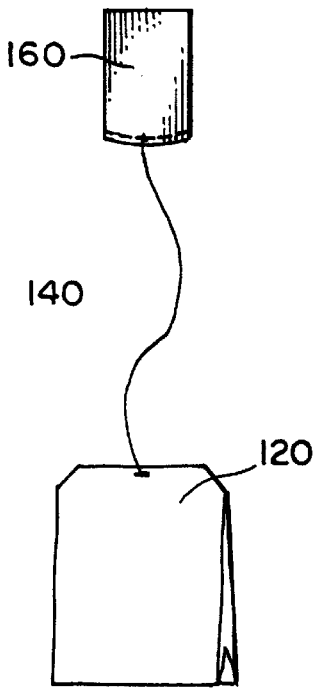
FIGS. 2*a*–2*d* are elevational views similar to FIG. 1 illustrating the steps performed in unfolding a tab to form a butler in accordance with the present invention.
Figure 2B:
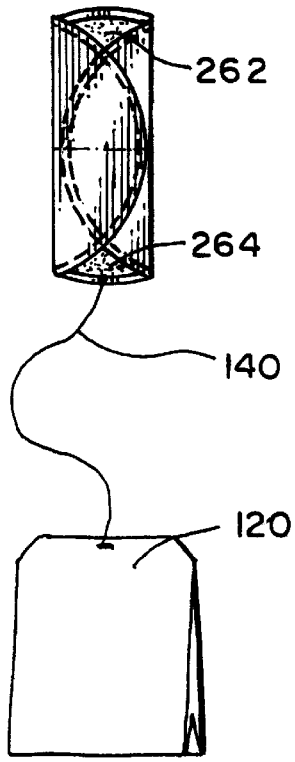

FIGS. 2*a*–2*d* illustrate exemplary steps performed in unfolding the tab 160 to form a butler 300 according to the present invention. More specifically, the tab 160 in FIG. 2*a* is unfolded through several steps, as illustrated, to form a butler 300 in FIG. 2*d*.

Figure 2C:
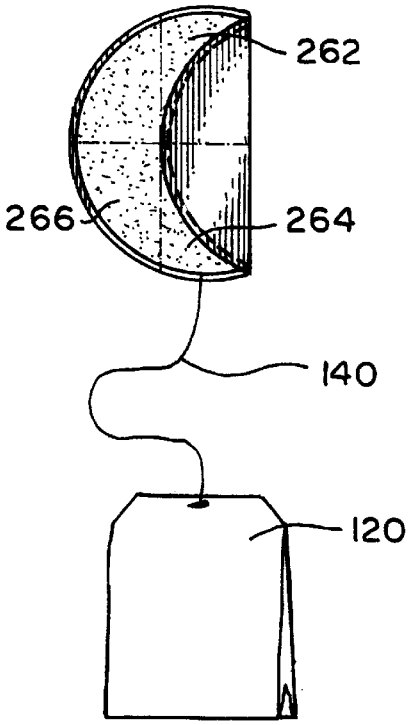
Figure 2D:
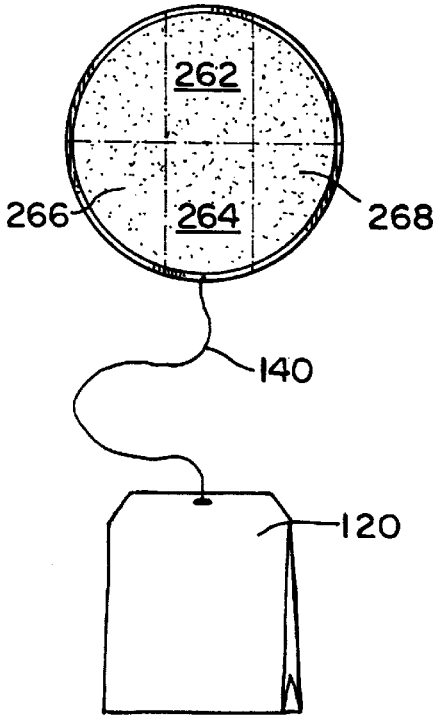

In FIG. 2*a*, the tab 160 is initially folded. Thereafter, in FIG. 2*b*, the tab 160 is unfolded once into two generally square halves 262 and 264. In FIG. 2*c*, the tab 160 is then unfolded into a semi-circular portion 266, and finally, in FIG. 2*d*, a second semi-circular portion 268 is unfolded to form a generally circular butler 300. Conversely, when generally circular, the butler 300 is first folded into thirds (FIG. 2*c*) and then into half (FIG. 2*b*) to form the generally square tab 160 (FIG. 2*a*). The butler 300 is initially folded to the size and shape of a standard tab and the tab 160 may be unfolded to form the butler 300. Other methods of folding the butler 300 to form tabs of the same size and shape or of differing sizes and/or shapes will become apparent to those of ordinary skill in the art.

Figure 3:
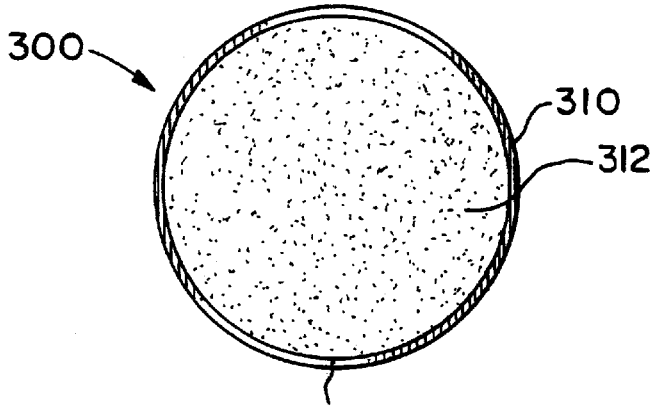
FIG. 3 is an enlarged top plan view of an open circular butler in accordance with the present invention.

FIG. 3 is an enlarged view of the preferred embodiment of the butler 300, illustrating an open and generally circular butler 300 according to the present invention. When fully open, the butler 300 comprises at least a first layer 310 and a second layer 312.

The material which forms the underlying first layer 310 when the butler 300 is oriented as shown is preferably a material that is impervious to liquids such as tea or water. The first layer 310 may be a metallic foil, a polymeric material or any other such liquid impervious material. The second layer 312 which faces upwardly when the butler 300 is oriented as shown is preferably made of a moisture-absorbent material. Paper materials such as those employed in the formation of paper towels, napkins or the like may be employed. Alternatively, an inexpensive woven material may be employed. Other moisture absorbent materials known to those of ordinary skill in the art may alternatively be employed. The two layers 310, 312 are secured together in any suitable manner such as utilizing an adhesive or otherwise directly bonding the liquid impermeable layer 310 to the absorbent layer 312. As previously discussed, the butler 300 is initially folded to function as the tab 160 for the porous holder 120. The butler 300 when unfolded is sized to receive the porous holder 120 after the beverage has been prepared. In one embodiment, the diameter of the fully opened butler 300 is approximately 2⅞ inches. However, it will be appreciated by those skilled in the art that the size of the butler 300 may vary from what is shown.

It should be appreciated by those of ordinary skill in the art that while in the present embodiment the butler 300 is generally round, the butler 300 could be of any other suitable shape such as square, rectangular, oblong or the like. The size and shape of the butler 300 must be taken into consideration when determining how the butler 300 is to be folded to form the tab 160.

Figure 4:
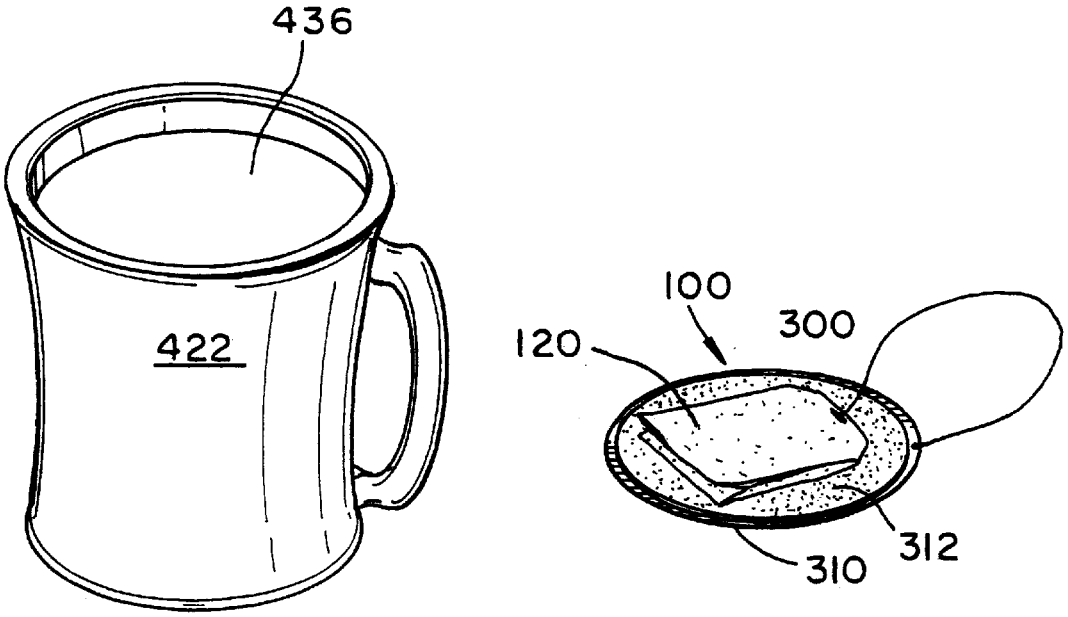
FIG. 4 is a perspective view of a mug of prepared beverage and a corresponding beverage bag received on a butler in accordance with the present invention.

FIG. 4 is a perspective view of a mug 422 containing a beverage and a corresponding porous holder beverage bag 120 received on a butler 300 according to the present invention. More specifically, a user has prepared hot tea 436 using a beverage bag or teabag 100 having the porous (filter) bag 120 disposed on the butler 300.

In use, the user wishing to prepare hot tea 436 inserts the filter bag 120 into hot water contained in the mug 422 while holding the tab 160 or positioning the tab 160 over the side of the mug. Upon completion of the brewing of the tea, the tab 160 (FIG. 2) may be unfolded as shown in FIGS. 2*a*–2*d* to form the butler 300. Thereafter, the user places the filter bag 120 and the string 140 on the butler 300. When the filter bag 120 is placed on the butler 300, any tea or other liquid which thereafter escapes from the filter bag 120 is quickly absorbed into the second or upper layer 312 of the butler 300 and is retained therein. The first or underlayer 310 of the butler 300 effectively precludes moisture contained within the upper layer 312 from reaching the underlying table or other supporting surface. When the user finishes consuming the tea 436, the butler 300 with the filter bag 120 thereon can be removed, crumpled or otherwise folded to enclose the filter bag 120 and conveniently disposed of in a waste can or other such device.

From the foregoing description, it can be seen that the present invention comprises a beverage bag, which includes a tab that unfolds to provide a convenient butler for receiving and retaining a used beverage bag thereon. The butler is effective in providing a means for convenient disposal of the beverage bag while providing protection for a table or underlying surface during consumption of the beverage. As mentioned above, the present invention is equally applicable to tea bags, and coffee bags or any other porous-type bag used for preparing a hot or cold beverage. It will be appreciated by those of ordinary skill in the art that modifications may be made to the above-described invention.

Therefore, the invention is not limited to the precise arrangement described but is equally applicable to all other embodiments within the scope of the invention as defined by the claims.

What is claimed is:

1. A beverage bag assembly which may be utilized to prepare hot or cold beverages, the beverage bag assembly comprising:

a porous bag containing a beverage making component, the porous bag being insertable into a liquid for preparing the beverage; and a generally rectangular tab having three straight sides and one curved side, said tab secured by a string to the porous bag, the tab being unfoldable from said generally rectangular configuration to form when fully unfolded a generally circular, flat butler which is sized for receiving and supporting the porous bag thereon after the beverage has been prepared, the butler being comprised of a first, lower layer of a material which is impervious to liquids and a second upper layer of a moisture absorbent material capable of directly contacting the porous bag when the porous bag is placed on said butler after the beverage has been prepared.

2. The beverage bag assembly of claim 1 wherein the circular butler is first foldable into thirds and is next foldable into half to form the generally rectangular tab.

* * * * *